US008851306B2

(12) United States Patent
Spurr et al.

(10) Patent No.: US 8,851,306 B2
(45) Date of Patent: Oct. 7, 2014

(54) CONCEALABLE STORAGE RACK

(75) Inventors: Steven Michael Joseph Spurr, Brownstone, MI (US); Elizabeth Mary Spurr, Brownstone, MI (US)

(73) Assignee: Coffee Keepers LLC, Brownstown, MI (US)

( * ) Notice: Subject to any disclaimer, the term of this patent is extended or adjusted under 35 U.S.C. 154(b) by 258 days.

(21) Appl. No.: 13/361,662

(22) Filed: Jan. 30, 2012

(65) Prior Publication Data

US 2012/0193313 A1 Aug. 2, 2012

Related U.S. Application Data

(60) Provisional application No. 61/438,044, filed on Jan. 31, 2011.

(51) Int. Cl.
*A47F 5/08* (2006.01)
*A47B 46/00* (2006.01)

(52) U.S. Cl.
CPC ..... *A47B 46/005* (2013.01)
USPC ..... 211/117

(58) Field of Classification Search
CPC ..... A47B 46/005; A47B 5/04; A47B 77/04; A47B 81/04
USPC ..... 211/90.01, 90.02, 117, 85.18, 85.13, 211/85.29, 150, 71.01, 74, 75, 168, 169, 211/175, 116; 108/4, 6, 9, 138, 149; 312/248, 245; 248/240, 240.1
See application file for complete search history.

(56) References Cited

U.S. PATENT DOCUMENTS

| | | | | |
|---|---|---|---|---|
| 3,099,355 | A * | 7/1963 | Kane | 211/75 |
| 3,331,645 | A * | 7/1967 | Vercellotti | 312/248 |
| 3,552,612 | A * | 1/1971 | Greis | 294/87.28 |
| 3,846,005 | A * | 11/1974 | Harper et al. | 312/248 |
| 5,242,219 | A * | 9/1993 | Tomaka | 312/245 |
| 5,302,015 | A * | 4/1994 | Du Vall | 312/282 |
| 5,329,865 | A * | 7/1994 | McWard | 109/50 |
| 5,487,525 | A * | 1/1996 | Drabczyk et al. | 248/639 |
| 5,646,819 | A * | 7/1997 | Hill, III | 361/679.6 |
| 5,725,293 | A * | 3/1998 | Wilkening et al. | 312/248 |
| 5,957,558 | A * | 9/1999 | Quade | 312/323 |
| 6,435,105 | B1 * | 8/2002 | Mikich et al. | 108/42 |
| 6,435,634 | B1 * | 8/2002 | Webb et al. | 312/313 |
| 6,964,343 | B2 * | 11/2005 | Tilly | 211/74 |
| 7,654,208 | B2 * | 2/2010 | Patten | 108/96 |
| 8,397,923 | B2 * | 3/2013 | Tan | 211/85.15 |

* cited by examiner

*Primary Examiner* — Darnell Jayne
*Assistant Examiner* — Hiwot Tefera
(74) *Attorney, Agent, or Firm* — Gifford, Krass, Sprinkle, Anderson & Citkowski, P.C.

(57) ABSTRACT

A concealable storage rack for mounting to an underside of the shelf includes a mounting bracket, a swing mechanism and a plate member. The storage rack hangidly supports containers having a readily extending flange. The mounting bracket is mounted to the underside of the shelf. The plate member includes a generally planar top surface having a plurality of apertures formed therein to hangidly support the containers. The plate member is pivotably attached to the mounting bracket by the swing mechanism for movement between a storage position in which the plate member is positioned adjacent to the mounting bracket and a use position in which the plate member is spaced apart from the mounting bracket.

15 Claims, 3 Drawing Sheets

CONCEALABLE STORAGE RACK

CROSS-REFERENCE TO RELATED APPLICATIONS

This application claims priority of U.S. Provisional Patent Application Ser. No. 61/438,044 filed Jan. 31, 2011, which is hereby incorporated by reference.

FIELD OF THE INVENTION

The present invention relates to a concealable storage rack. More particularly, a storage rack mounted underneath a shelf for hanging the supporting containers and moveable between a storage position and a use position.

BACKGROUND OF THE INVENTION

In recent years, single serving coffee machines commonly sold under the trademark "Keurig" have become popular. These types of single serving coffee machines utilize a pre-packaged single serving container of coffee grounds or other brewing material such as tea or hot chocolate. The single serving containers are common sold under the trademark "K-cup". The convenience of the single serving coffee machine allows a user to select the exact type of coffee to be brewed for the individual enjoyment of the user. The single serving containers include an upper surface having an indicia relating to the type of coffee and brand contained therein.

One particular disadvantage of the single serving coffee machines utilizing the single serving container is storage of the single serving containers. In order to properly display the various types of coffee types and brands available for brew by a user, the single serving containers must be oriented such that a user can quickly identify the indicia on the upper surface. Although storage of the single serving containers within a cupboard or drawer frees valuable counter space, it requires a user to search through the various single serving containers to identify each of the available coffee brands and types.

One previous attempt in providing a storage option for the single service containers is a carrousel type device. These carrousels include a stand on a rotating base and include receptacles for the single serving containers. The carrousel rotates about the base to provide the user with the ability to view all of the available single serving containers. However, these carrousels take up valuable countertop space and have a reduced esthetically pleasing appearance when only partially filled. As such, the previously known storage options require the use of valuable countertop space and constant refilling.

Thus, there exists a need for an improved storage system which allows a user to easily identify the type and brand of each single serving container, and which frees up valuable countertop space.

SUMMARY OF THE INVENTION

The present invention provides an improved storage assembly which overcomes the above-mentioned disadvantages of the previously known storage devices for storing and displaying single serving containers used with single serving coffee machines.

In brief, a concealable storage rack for mounting to an underside of the shelf includes a mounting bracket, a swing mechanism and a plate member. The storage rack hangidly supports containers having a radially extending flange. The mounting bracket is mounted to the underside of the shelf. The plate member includes a generally planar top surface having a plurality of apertures formed therein to hangidly support the containers. The plate member is pivotably attached to the mounting bracket by the swing mechanism for movement between a storage position in which the plate member is positioned adjacent to the mounting bracket and a use position in which the plate member is spaced apart from the mounting bracket.

In the storage position, the plate member is parallel to the underside of the shelf. However, in the use position, the plate member is tilted at an unparallel orientation with respect to the underside of the shelf. The vertical distance between a front end of the plate member and the underside of the shelf is greater than a vertical distance between a rear end of the plate member and the underside of the shelf when in the use position.

The swing mechanism includes a pair of link mechanisms. The pair of link mechanisms interconnects the sides of the mounting plate to the sides of the mounting bracket. Each of the pair of link mechanisms includes a front link and a rear link member. The front link members have a length which is greater than a length of the rear link members.

BRIEF DESCRIPTION OF THE DRAWINGS

A better understanding of the present invention will be had upon reference to the following detailed description when read in conjunction with the accompanying drawings, wherein like reference characters refer to the like parts throughout the several views and in which.

DETAILED DESCRIPTION OF THE INVENTION

The present invention has utility as a concealable storage rack that provides storage for containers having radially extending flanges. The storage rack is mounted underneath a shelf and moveable between a storage position and a used position. By mounting the storage rack underneath the shelf, the containers can be stored and displayed without taking up valuable counter space.

Figure 1:
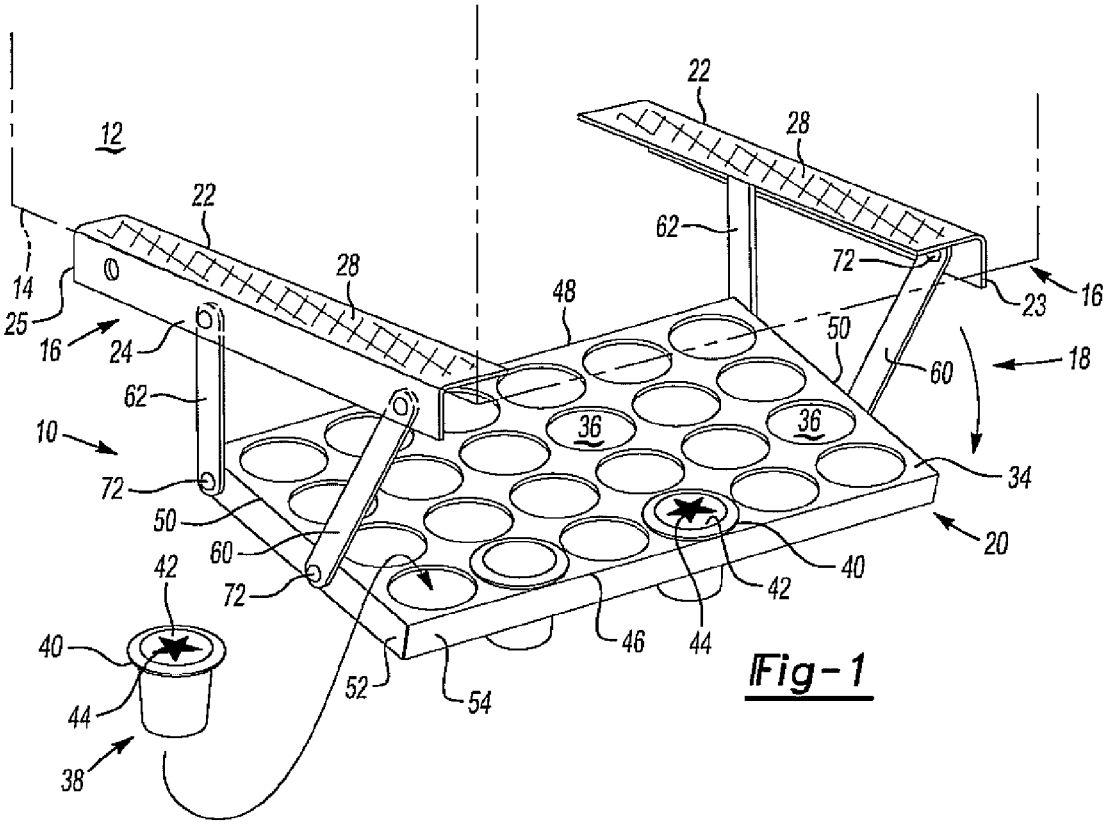
FIG. 1 is a perspective view of the invented storage assembly illustrating a storage rack in a use position.
Figure 2:
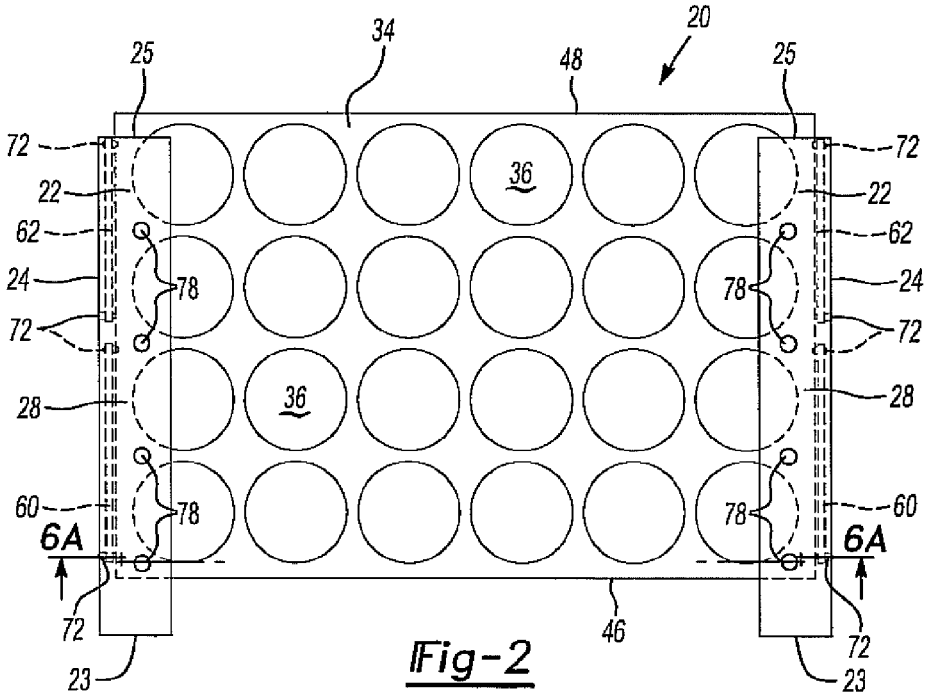
FIG. 2 is a top elevational view illustrating the invented storage rack in a storage position.

With reference to FIG. 1, a concealable storage rack is generally indicated at 10. The storage rack 10 includes mounting brackets 16, swing mechanism 18, and plate member 20. The storage rack 10 is concealable beneath a cabinet or shelf 12. The cabinet or shelf 12 is optionally an upper cabinet provided within the kitchen or other environment or a shelf or countertop. It is appreciated, of course, that the cabinet or shelf 12 is non-limiting and thus includes any structure having an underside 14 capable of mounting the storage rack thereto. The mounting brackets 16, the swing mechanism 18, and the plate member 20 are formed of a rigid material, illustratively including metallic materials, plastics, or wood.

Figure 6A:
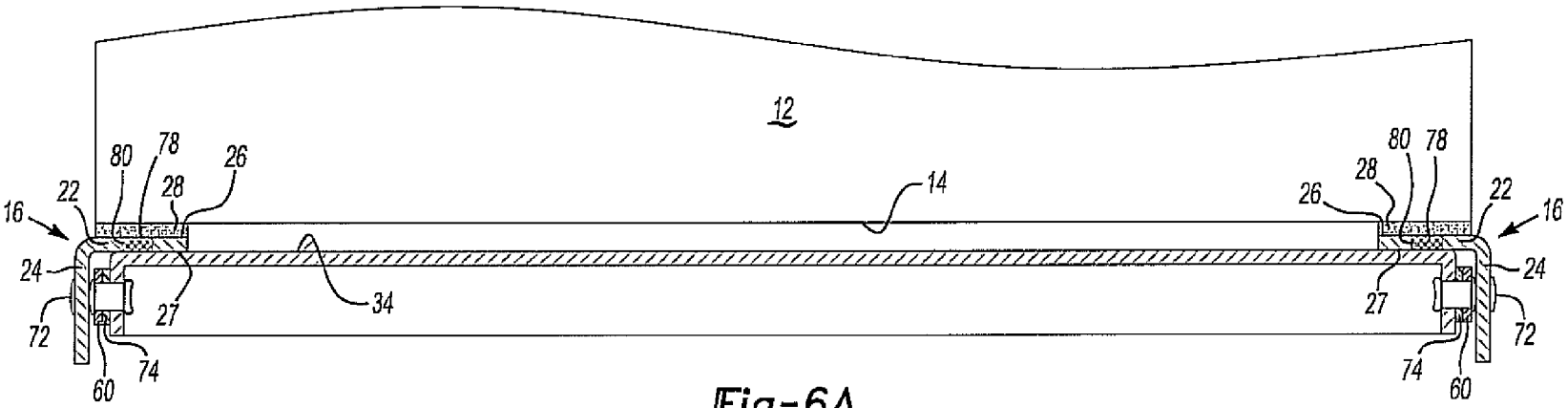
FIG. 6A is a cross sectional view of the storage rack.
Figure 6B:
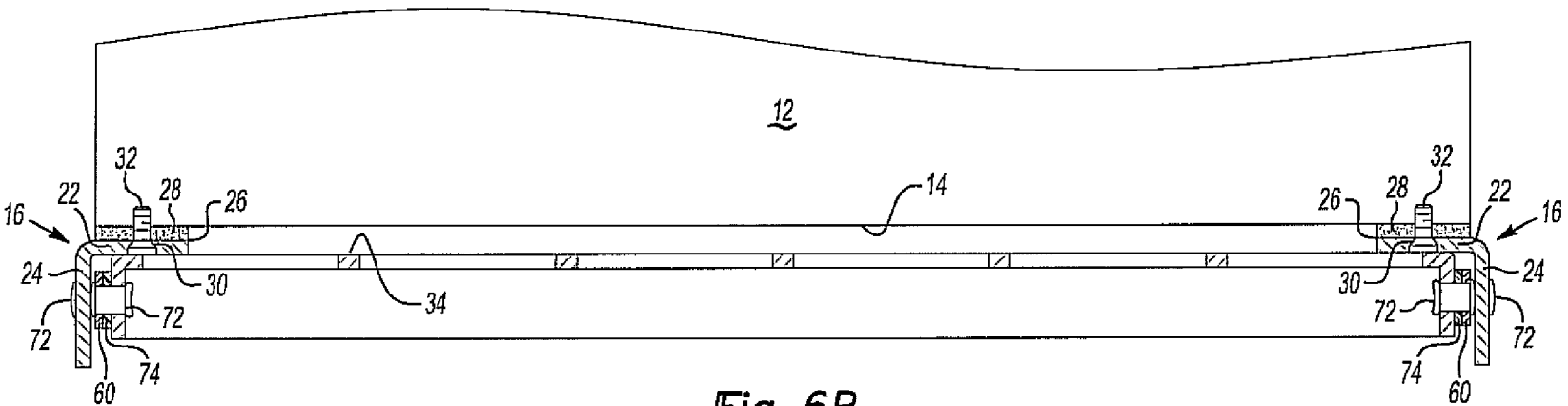
FIG. 6B is an alternative cross sectional view of the storage rack.

The mounting brackets 16 are illustrated as a pair of brackets, however, a single bracket having an inverted U shape is optionally provided. The mounting brackets 16 has a generally L-shape defined by a mounting arm 22 and a normally extending support arm 24. The mounting arm 22 has an upper surface 26 which is mounted the underside 14 of the shelf 12. With reference to FIG. 6A, the upper surface 26 of the mounting arm 22 is mounted to the underside 14 of the shelf 12 by a high-strength adhesive 28. In alternative to or in combination with the high-strength adhesive 28, the mounting arm 22 optionally includes bores 30 through which fasteners 32 can mount the mounting arm 22 to the underside 14 of the shelf 12 as seen in FIG. 6B. The adhesive is optionally a double sided adhesive tape having one side adhered to the upper surface 26 of the mounting arm 22 and an opposite side adhered to the underside 14 of the shelf 12. It is appreciated, of course, that the upper surface 26 of the mounting arm 22 is mounted to the underside 14 of the shelf 12 by any means known to those who are skilled in the art illustrating and including hook and loop attachments sold under the trademarks Velcro, magnets, or snap tabs.

Returning to FIG. 1, the plate member 20 includes a generally planer top surface 34 having a plurality of apertures 36. Although in the illustrated embodiments, the plate member 20 has a rectangular or square shape; however, the plate member 20 is not limited to such a shape.

The apertures 36 are provided in equally spaced and evenly distributed rows and columns across the plate member 20 The apertures 36 have a diameter dimension to receive a container 38. Specifically, the container 38 includes an outwardly or radially extending flange 40. The diameter of the aperture 34 is less than the diameter of the flange 40 such that upon insertion of the bottom end of the container 38 within the aperture 36 the flange 40 abuts the top surface 34 of the plate member 20 to hangidly support the container 38. The container 38 further includes an upper surface 42 formed typically of a foil type material. The upper surface 42 includes an indicia 44 identifying the contents of the container 38 such as coffee type and coffee brand.

The plate member 20 includes a front end 46, a rear end 48, and a pair of side ends 50 extending between the front end 46 and the rear end 48. A pair of side walls 52 extend generally normal from the plate member 20 at the side ends 50 in a direction downwardly with respect to the underside 14 of the shelf 12. Similarly, a front wall 54 extends generally normal from the plate member 20 at the front end 46 in a direction generally downward with respect to the underside 14 of the shelf 12, and a rear wall 56 extends generally normal from the plate member 20 at the rear end 48 in a direction downwardly with respect to the underside 14 of the shelf 12.

Figure 3:
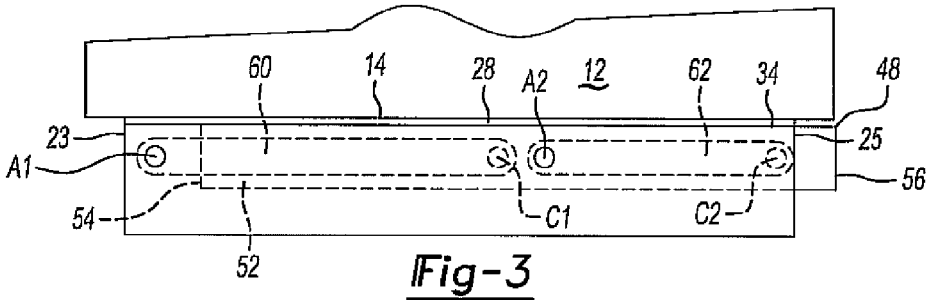
FIG. 3 is a side elevational view illustrating the storage rack in the storage position.
Figure 4:
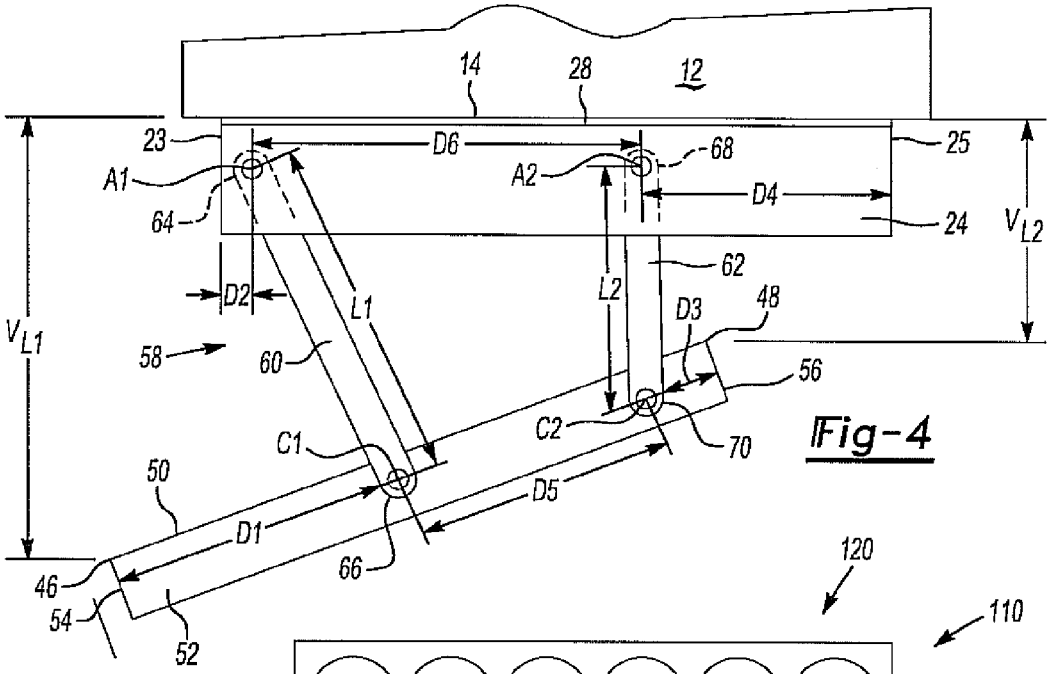
FIG. 4 is a side elevational view illustrating the storage rack in the use position.

With reference to FIGS. 3 and 4, the swing mechanism 18 is provided to swing the plate member 20 between a storage position, as best seen in FIG. 3, and a use position, as best seen in FIG. 4. The swing mechanism 18 includes a pair of link mechanisms 58, with one link mechanism 58 disposed on either side of the plate member 20 and at either support walls 54 of the bracket 16. As the pair of link members 58 are symmetric, only one of the pair of link members 58 will be discussed in an effort to provide a concise explanation.

The link mechanism 58 includes a front link member 60 and a rear link member 62. The front link member 60 has a first proximate end 64 pivotally mounted to the support arm 24 of the bracket 16 at a first attachment point A1. The front link member 60 has a first distal end 66 pivotally mounted to the side wall 52 of the plate member 20 at a first connection point C1. Similarly, the rear link member 62 has a second proximate end 68 pivotally mounted to the support arm 24 of the bracket 16 at a second attachment point A2. The rear link member 62 has a second distal end 70 pivotally mounted to the side wall 52 of the plate member 20 at a second connection point C2.

As best seen in FIGS. 6A and 6B the first proximate end 64, the first distal end 66, the second proximate end 68 and the second distal end 70 are pivotably attached to the support arm 24 and the side wall 52, respectively, by rivets 72. It is appreciated, of course, that the first proximate end 64 and the second proximate 68, and the first distal end 66 and the second distal end 70 are pivotably mounted to the support are 24 and the side wall 52, respectively, by any means known to those in the art illustratively including screws, pins, and fasteners. Optionally, a washer 74 such as a nylon washer is provided within the pivotal mount between the support arm 24 and the first proximate end 64, the support arm 24 and the second proximate end 68, the side wall 52 and the first distal end 66 and the side wall 52 and the second distal end 70. It is appreciated, of course, that the connection between the first distal end 66 and second distal end 70 and the side wall 52 of the plate member 20 optionally include a pair of washers 74.

As seen in FIG. 4, the storage rack 10 specifically the plate member 20 is provided at an angle so as to display the indicia 44 on the upper surface 42 of the containers 38 to a user upon movement of the plate member 20 from the storage position, as best seen in FIG. 3, to the use position as best seen in FIG. 4. Specifically, the plate member 20 is provided at an angled orientation such that the plate member 20 is tilted at an unparallel orientation with respect to the underside 14 of the shelf 12. In order to provide such an angled and unparallel orientation the front link member 60 is provided with a length L1 that is greater than the length L2 of the rear link member 62. A ratio of the lengths L1 and L2 of the front link member 60 and the rear link member 62 is provided in the range of 0.645:0.75

In addition, the distance D5, between the first connection point C1 and the second connection point C2, is less than the distance D6, between the first attachment point A1 and the second attachment point A2. By configuring the swing mechanism 18 such that the length L1 is greater than the length L2, and the distance D6 is greater than the distance D5 provides a four bar system in which the top surface 34 of the plate member 20 will be at an unparallel orientation, with respect to the underside 14 of the shelf, so as to face a user when in the use position and that the top surface 34 of the plate member 20 will be provide adjacent the underside 14 of the shelf 12 in the storage position.

The length L1 of the front link members 60 being larger than the length L2 of the rear link member 62 provided with the distance D6 being greater than distance D5 provides the storage rack 10 to be moveable into a use position having an angle generally between 30 and 60 degrees, preferably 45 degrees from the horizontal. As best seen in FIG. 4, when in the use position the top surface, and consequently, the upper surface 42 and indicia 44 of any containers 38 provided within the plate member 20 is provided at an angle so as to be easily identified by a user. The plate member 20 is provided in a tilted manner at an unparallel orientation with respect to the underside 14 of the shelf 12 such that a vertical distance V1 between the front end 46 of the plate member 20 and the underside 14 of the shelf 12 is greater than the vertical distance V2 between the rear end 48 of the plate member 20 and the underside 14 of the shelf 12.

Further, the distance D1 between the front end 46 of the plate member 20 and the first connection point C1 is greater than the distance D2 between the front end 23 of the bracket 16 and the first attachment point A1. In addition, the distance D3 between the second connection point C2 and the rear end 56 of the plate member 20 is less than the distance D4 between the second attachment point A2 and the rear end 25 of the bracket 16. Such a configuration allows the front end 46 of the plate member 20 to be concealed by being spaced behind a front face of the shelf 12 in the storage position, and allows the front end 46 of the plate member 20 to extend beyond the front face of the shelf 12 when in the use position thereby allowing a user to easily remove a container 38 from one of the apertures 36.

As best seen in FIGS. 6A and 6B, in the storage position, the link mechanisms 58 are positioned between the side wall 52 of the plate member 20 and the interior surface of the support arm 24 of the bracket 16, thereby allowing the plate member 20 to be concealed within the bracket 16 and consequently the underside 14 of the shelf 12. In addition, in the storage position the top surface 34 of the plate member 20 is positioned adjacent the mounting bracket 16 specifically the bottom surface 27 of the mounting arm 22. Specifically, when no containers 38 are received within the apertures 36, the top surface 34 of the plate member 20 will contact the bottom surface 27 of the mounting arm 22.

In order to hold the plate member 20 in the storage position, the rivets 72 have sufficient compression to provide a friction force between the washer 74, the link mechanism 58 and the side wall 52 and the support arm 24 which is greater than the gravitational force acting upon the plate member 20 even in the event of a fully loaded plate member 20 having a container 38 hangidly received within each aperture 36.

The storage rack 10 optionally includes magnets 78 provided in bores 80 formed in the mounting arm 22 of the mounting brackets 16. The magnets 78 are provided in the storage rack having the plate member 20 or at least a portion of the top surface 34 having a magnetically reacting material. The magnets 78 have a top surface contacting the adhesive 28 which supports the retention of the magnets 78 within the bores 80, and bottom surface that contacts the top surface 34 of the plate member 20. The interference fit between the bore 80 and the magnets 78 along with the contact between the top surface of the magnet 78 and the adhesive 28 restrain the magnet 78 in position. The magnets 78 provide a magnetic force that, acting in conjunction with the compressive force by rivets 72, is greater than the gravitational force acting on the plate member 20 so as to retain the mounting plate 20 in the storage position. It is appreciated, of course, that other additional attachments to releasably support the plate member 20 in the storage position are applicable illustratively including biasing member such as springs, dimples stamped into any or all of the link plate member 20, the front link members 60, the rear link members 62, and the mounting brackets 16.

Figure 5:
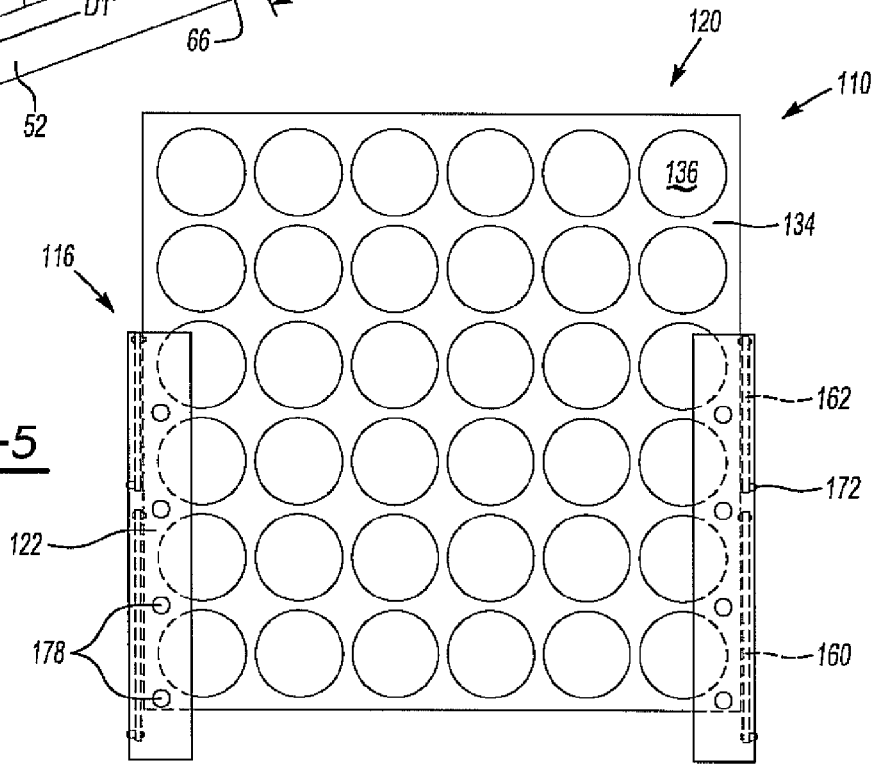
FIG. 5 is a top elevational view of an alternative storage rack having a high capacity mounting plate.

With reference to FIG. 5, an alternative storage rack 110 is illustrated. The storage rack 110 includes a plate member 120 having a larger number of apertures 136 to hangidly support a larger number of containers 38.

Although the disclosure states that containers 38 are provided that the brewing product for use in a single serving coffee brewing machines, the storage rack 10 is not limited to such use. The storage rack 10 is applicable to conceal and store objects containing various varieties of products either edible or inedible. In addition, the apertures 36 are optionally different shapes rather than the illustrated circular shape illustrating and including squares, rectangles, triangles or other regular and irregular shapes. The shape of the aperture 36 are dependent upon the shape of the outwardly extending flange 40 of container 38 and as long as the apertures 36 allow a portion of the container 38 to be received therein such that the outwardly extending flange 40 abuts the top surface 34 of the plate member 20 or such that the insertion of the container 38 within the aperture 36 provides an interference fit so as to hangidly support the container 38 the concealable storage rack 10 is applicable.

From the foregoing, it can be seen that the present invention provides a concealable storage rack having a plate member moveable between a storage position and a use position which overcome the above-described disadvantages of the prior art. Having described the invention, however, many modifications thereto it will become apparent to those who are skilled in the art to which it pertains without deviation from the spirit of the invention as defined in the scope of the amended claims.

It is claimed:

1. A concealable storage rack mounted to an underside of a shelf, said storage rack hangidly supporting containers, said storage rack comprising:

a pair of mounting brackets, each of said pair of mounting brackets having a mounting arm and a support arm defining a generally L-shape, each of said mounting arms having an upper mounting surface mounted to the underside of the shelf and an opposite lower surface, and each of said support arms extend downwardly with respect to the underside of the shelf;

a plate member having a generally planar top surface with a front end and an opposite rear end and a pair of side walls that extend between said front end and said rear end and a plurality of apertures adapted to hangidly support the containers;

a pair of front link members and a pair of rear link members, said pair of front link members having a length greater than a length of said pair of rear link members, one of each of said pair of front link members and said pair of rear link members extends rigidly between said support arm of one of said mounting brackets and one of a pair of side walls of said plate member, and an other of each of said pair of front link members and said rear link members extends rigidly between said support arm of an other of said mounting bracket and an other of said pair of side walls of said plate member;

said plate member being pivotally attached to said mounting bracket by said pair of front link members and said pair of rear link members for movement between a storage position and a use position, in said storage position said top surface of said plate member contacts said lower surface of each of said mounting arms and in said use position said plate member is spaced apart from said shelf such that a vertical distance between said front end of said plate member and the underside of the shelf is greater than a vertical distance between said rear end of said plate member and the underside of the shelf and in which said front end of said plate member extends farther in a forward direction than said front end of said plate member in said storage position.

2. The concealable storage rack of claim 1, wherein in said storage position said plate member is parallel to the underside of the shelf with said pair of front link members and said pair of rear link members extending parallel with said plate member.

3. The concealable storage rack of claim 1, wherein plate member has a generally rectangular shape, and wherein each of said pair of side walls extend in a direction generally normal from said plate member and in a downwardly direction with respect to the underside of the shelf.

4. The concealable storage rack of claim 3, wherein each of said front link members includes a first proximate end and a first distal end, said first proximate end pivotally mounted to one of said support arms at a first attachment point, said first distal end pivotally mounted to one of said pair of side walls at a first connection point, and wherein each of said rear link members includes a second proximate end and a second distal end, said second proximate end pivotally mounted to one of said support arms at a second attachment point, said second distal end pivotally mounted to one of said pair of side walls at a second connection point.

5. The concealable storage rack of claim 4, wherein a distance between said first attachment point and said second attachment point is greater than a distance between said first connection point and said second connection point.

6. The concealable storage rack of claim 1, wherein the containers includes an outwardly extending flange and wherein a diameter of each of said plurality of apertures is less than a diameter of the flange of the containers so as to hangidly support the containers.

7. The concealable storage rack of claim 6, wherein said plurality of apertures are arranged in a plurality of evenly distributed rows or a plurality of evenly distributed columns.

8. A storage assembly for mounting to an underside of a shelf, said storage assembly comprising:

at least one container having a flange and an upper surface having an indicia; and a concealable storage rack having a pair of mounting brackets, a plate member and a pair of front link members and a pair of rear link members, said pair of mounting brackets having a mounting arm and a support arm defining a generally L-shape, each of said mounting arms having an upper mounting surface mounted to the underside of the shelf and an opposite lower surface, and each of said support arms extend downwardly with respect to the underside of the shelf;

said plate member having a generally planar top surface with a front end and an opposite rear end and a pair of side walls that extend between said front end and said rear end, said plate member having a plurality of apertures formed therein, said plurality of apertures having a diameter less than a diameter of said flange of said at least one container such that upon insertion of said at least one container within one of said plurality of apertures said flange abuts said top surface to hangidly support said at least one container within said plate member;

said pair of front link members having a length greater than a length of said pair of rear link members, one of each of said pair of front link members and said pair of rear link members extends rigidly between said support arm of one of said mounting brackets and one of a pair of side walls of said plate member, and an other of each of said pair of front link members and said rear link members extends rigidly between said support arm of an other of said mounting bracket and an other of said pair of side walls of said plate member;

said plate member being pivotally attached to said pair of mounting brackets by said pair of front link members and said pair of rear link members for movement between a storage position and a use position, in said storage position said top surface of said plate member contacts said lower surface of each of said mounting arms and in said use position said plate member is spaced apart from said shelf such that a vertical distance between said front end of said plate member and the underside of the shelf is greater than a vertical distance between said rear end of said plate member and the underside of the shelf and in which said front end of said plate member extends farther in a forward direction than said front end of said plate member in said storage position to display said indicia on said upper surface of said container to a user.

9. The storage assembly of claim 8, wherein in said storage position said plate member is parallel to the underside of the shelf with said pair of front link members and said pair of rear link members extending parallel with said plate member.

10. The storage assembly of claim 8, wherein plate member has a generally rectangular shape, and wherein each of said pair of side walls extend in a direction generally normal from said plate member and in a downwardly direction with respect to the underside of the shelf.

11. The storage assembly of claim 10, wherein each of said front link members includes a first proximate end and a first distal end, said first proximate end pivotally mounted to one of said support arms at a first attachment point, said first distal end pivotally mounted to one of said side walls at a first connection point, and wherein each of said rear link members includes a second proximate end and a second distal end, said second proximate end pivotally mounted to one of said support arms at a second attachment point, said second distal end pivotally mounted to one of said side walls at a second connection point.

12. The storage assembly of claim 11, wherein a distance between said first attachment point and said second attachment point is greater than a distance between said first connection point and said second connection point.

13. The storage assembly of claim 11, wherein said first proximate ends and said second proximate ends are pivotally mounted to either of said sides of said mounting bracket by rivets, and wherein said first distal ends and said second distal ends are pivotally mounted to either of said sides of said plate member by rivets.

14. The storage assembly of said claim 13, wherein said rivets include at least one nylon washer between each of said first proximate ends and said mounting bracket, said first distal ends and said plate member, said second proximate ends and said mounting bracket, and said second distal ends and said plate member.

15. The storage assembly of claim 8, wherein said plurality of apertures are arranged in a plurality of evenly distributed rows or a plurality of evenly distributed columns.

* * * * *